US006251282B1

(12) United States Patent
Putvinski et al.

(10) Patent No.: US 6,251,282 B1
(45) Date of Patent: Jun. 26, 2001

(54) PLASMA FILTER WITH HELICAL MAGNETIC FIELD

(75) Inventors: Sergei Putvinski; Tihiro Ohkawa, both of La Jolla; Richard L. Freeman, Del Mar, all of CA (US)

(73) Assignee: Archimedes Technology Group, Inc., San Diego, CA (US)

( * ) Notice: Subject to any disclaimer, the term of this patent is extended or adjusted under 35 U.S.C. 154(b) by 0 days.

(21) Appl. No.: 09/456,795

(22) Filed: Dec. 8, 1999

Related U.S. Application Data

(63) Continuation-in-part of application No. 09/192,945, filed on Nov. 16, 1998, now Pat. No. 6,096,220.

(51) Int. Cl.[7] ..... B03C 1/00

(52) U.S. Cl. ..... 210/695; 210/748; 210/222; 210/243; 209/12.1; 209/227; 204/554; 204/660; 96/2; 96/3; 95/28

(58) Field of Search ..... 95/28; 96/1, 2, 96/3; 209/12.1, 222, 722; 210/222, 223, 243, 695, 748; 204/554, 660

(56) References Cited

U.S. PATENT DOCUMENTS 3,722,677 3/1973 Lehnert .
5,039,312 8/1991 Hollis, Jr. et al. .

OTHER PUBLICATIONS

Bittencourt, J.A., and Ludwig, G.O.; Steady State Behavior of Rotating Plasmas in a Vacuum–Arc Centrifuge; *Plasma Physics and Controlled Fusion*, vol. 29, No. 5, pp. 601–620; Great Britain, 1987.

Bonnevier, Björn; Experimental Evidence of Element and Isotope Separation in a Rotating Plasma; *Plasma Physics*, vol. 13; pp. 763–774; Northern Ireland, 1971.

Kim, C.; Jensen, R.V.; and Krishnan, M; Equilibria of a Rigidly rotating, Fully Ionized Plasma Column; *J. Appl. Phys.*, vol. 61, No. 9; pp. 4689–4690; May, 1987.

Dallaqua, R.S.; Del Bosco, E.; da Silva, R.P.; and Simpson, S.W.; Langmuir Probe Measurements in a Vacuum Arc Plasma Centrifuge; *IEEE Transactions on Plasma Science*, vol. 26, No. 3, pp. 1044–1051; Jun. 1998.

Dallaqua, Renato Sérgio; Simpson, S.W. and Del Bosco, Edson; Experiments with Background Gas in a Vacuum Arc Centrifuge; *IEEE Transactions on Plasma Science*, vol. 24, No. 2; pp. 539–545; Apr. 1996.

Dallaqua, R.S.; Simpson, S.W.; and Del Bosco, E; Radial Magnetic Field in Vacuum Arc Centrifuges; *J. Phys. D.Appl.Phys.*, 30; pp. 2585–2590; UK, 1997.

Evans, P.J.; Paoloni, F. J.; Noorman, J. T. and Whichello, J. V.; Measurements of Mass Separation in a Vacuum–Arc Centrifuge; *J. Appl phys.* 6(1); pp. 115–118; Jul. 1, 1989.

(List continued on next page.)

*Primary Examiner*—David A. Reifsnyder
(74) *Attorney, Agent, or Firm*—Nydegger & Associates

(57) ABSTRACT

A plasma mass filter using a helical magnetic field for separating low-mass particles from high-mass particles in a multi-species plasma includes a cylindrical outer wall located at a distance "a" from a longitudinal axis. Also included is a coaxial cylindrical inner wall positioned to establish a plasma chamber between the inner and outer walls. The magnetic field is generated in this chamber with an axial component ($B_z$) and an azimuthal component ($B_\theta$), which interact together with an electric field to create crossed magnetic and electric fields. The electric field has a positive potential, $V_{ctr}$, on the inner wall and a zero potential on the outer wall. With these crossed magnetic and electric fields, a multi-species plasma is moved through the chamber with a velocity, $v_z$, high-mass particles in the plasma ($M_2$) are ejected into the outer wall and low-mass particles ($M_1$) are confined in the chamber during transit of the chamber to separate the low-mass particles from the high-mass particles, where $M_1<M_c<M_2$, and where $M_c=(ea^2(B_z^2+B_\theta^2)/8v)\{f(B_\theta/B)\}$.

20 Claims, 2 Drawing Sheets

OTHER PUBLICATIONS

Geva, M.; Krishnan, M; and Hirshfield, J. L. ; Element and Isotope Separation in a Vacuum–Arc Centrifuge; *J. Appl. Phys* 56(5); pp. 1398–1413; Sep. 1, 1984.

Krishnan, M.; Centrifugal Isotope Separation in Zirconium Plasmas; *Phys. Fluids* 26(9); pp. 2676–2682; Sep. 1983.

Krishnan, Mahadevan; and Prasad, Rahul R.; Parametric Analysis of Isotope Enrichment in a Vacuum–Arc Centrifuge; J. Appl. Phys. 57(11); pp. 4973–4980; Jun. 1, 1985.

Prasad, Rahul R. and Krishnan, Mahadevan; Theoretical and Experimental Study of Rotation in a Vacuum–Arc Centrifuge; *J. Appl. Phys.*, vol. 61, No. 1; pp. 113–119; Jan. 1, 1987.

Prasad, Rahul R. and Mahadevan Krishnan; Article from *J. Appl. Phys.* 61(9); American Institute of Physics; pp. 4464–4470; May, 1987.

Qi, Niansheng and Krishnan, Mahadevan; Stable Isotope Production; p. 531.

Simpson, S.W.; Dallaqua, R.S.; and Del Bosco, E.; Acceleration Mechanism in Vacuum Arc Centrifuges; *J. Phys. D: Appl. Phys.* 29; pp. 1040–1046; UK, 1996.

Slepian, Joseph; Failure of the Ionic Centrifuge Prior to the Ionic Expander, p. 1283; Jun., 1955.

PLASMA FILTER WITH HELICAL MAGNETIC FIELD

This application is a continuation-in-part of application Ser. No. 09/192,945 filed Nov. 16, 1998, now U.S. Pat. No. 6,096,220. The contents of application Ser. No. 09/192,945 now U.S. Pat. No. 6,093,320 are incorporated herein by reference.

FIELD OF THE INVENTION

The present invention pertains generally to systems and apparatus which are useful for separating charged particles in a multi-species plasma according to their respective mass. More particularly, the present invention pertains to plasma mass filters which rely on specially configured crossed magnetic and electric fields, and on low collisionality between charged particles, to eject high-mass particles from a plasma chamber while confining low-mass particles in the chamber as the plasma transits through the chamber. The present invention is particularly, but not exclusively, useful for moving a multi-species plasma through a plasma mass filter by generating an axial velocity for the plasma.

BACKGROUND OF THE INVENTION

The general principles of operation for a plasma centrifuge are well known and well understood. In short, a plasma centrifuge generates forces on charged particles which will cause the particles to separate from each other according to their mass. More specifically, a plasma centrifuge relies on the effect that crossed electric and magnetic fields have on charged particles. As is known, crossed electric and magnetic fields will cause charged particles in a plasma to move through the centrifuge on respective helical paths around a centrally oriented longitudinal axis. As the charged particles transit the centrifuge under the influence of these crossed electric and magnetic fields they are, of course, subject to various forces. Specifically, in the radial direction, i.e. a direction perpendicular to the axis of particle rotation in the centrifuge, these forces are: 1) a centrifugal force, $F_c$, which is caused by the motion of the particle; 2) an electric force, $F_E$, which is exerted on the particle by the electric field, $E_r$; and 3) a magnetic force, $F_B$, which is exerted on the particle by the magnetic field, $B_z$. Mathematically, each of these forces are respectively expressed as:

$F_c = Mr\omega^2$;

$F_E = eE_r$; and $F_B = er\omega B_z$.

Where:

M is the mass of the particle;

r is the distance of the particle from its axis of rotation;

ω is the angular frequency of the particle;

e is the electric charge of the particle;

E is the electric field strength; and $B_z$ is the magnetic flux density of the field.

In a plasma centrifuge, it is universally accepted that the electric field will be directed radially inward. Stated differently, there is an increase in positive voltage with increased distance from the axis of rotation in the centrifuge. Under these conditions, the electric force $F_E$ will oppose the centrifugal force $F_C$ acting on the particle, and depending on the direction of rotation, the magnetic force either opposes or aids the outward centrifugal force. Accordingly, an equilibrium condition in a radial direction of the centrifuge can be expressed as:

$\Sigma F_r = 0$ (positive direction radially outward);

$F_c - F_E - F_B = 0$;

$$Mr\omega^2 - eE_r - er\omega B_z = 0. \quad \text{(Eq. 1)}$$

It is noted that Eq. 1 has two real solutions, one positive and one native, namely:

$$\omega = \Omega/2(1 \pm \sqrt{1 + 4E_r/(rB_z\Omega)})$$

where $\omega = eB_z/M$.

For a plasma centrifuge, the intent is to seek an equilibrium to create conditions in the centrifuge which allow the centrifugal forces, $F_c$, to separate the particles from each other according to their mass. This happens because the centrifugal forces differ from particle to particle, according to the mass (M) of the particular particle. Thus, particles of heavier mass experience greater $F_c$ and move more toward the outside edge of the centrifuge than do the lighter mass particles which experience smaller centrifugal forces. The result is a distribution of lighter to heavier particles in a direction outward from the mutual axis of rotation. As is well known, however, a plasma centrifuge will not completely separate all of the particles in the aforementioned manner.

As indicated above in connection with Eq. 1, a force balance can be achieved for all conditions when the electric field E is chosen to confine ions, and ions exhibit confined orbits. In the plasma filter of the present invention, unlike a centrifuge, the electric field is chosen with the opposite sign to extract ions. The result is that ions of mass greater than a cut-off value, $M_c$, are on unconfined orbits. The cut-off mass, $M_c$, can be selected by adjusting the strength of the electric and magnetic fields. The basic features of the plasma filter can be described using the Hamiltonian formalism.

The total energy (potential plus kinetic) is a constant of the motion and is expressed by the Hamiltonian operator:

$$H = e\Phi + (P_r^2 + P_z^2)/(2M) + (P_\theta - e\Psi)^2/(2Mr2)$$

where $P_r = Mv_r$, $P_\theta = Mrv_\theta + e\Psi$, and $P_z = Mv_z$ are the respective components of the momentum and $e\Phi$ is the potential energy. $\Psi = r^2B_z/2$ is related to the magnetic flux function and $\Psi = V_{ctr} - \alpha\Psi$ is the electric potential. $E = -\nabla\Psi$ is the electric field which is chosen to be greater than zero for the filter case of interest. We can rewrite the Hamiltonian:

$$H = eV_{ctr} - e\alpha r^2B_z/2 + (P_r^2 + P_z^2)/(2M) + (P_\theta - er^2B_z/2)^2/(2Mr^2).$$

We assume that the parameters are not changing along the z axis, so both $P_z$ and $P_\theta$ are constants of the motion. Expanding and regrouping to put all of the constant terms on the left hand side gives:

$$H - eV_{ctr} - P_z^2/(2M) + P_\theta\Omega/2 = P_r^2/(2M) + (P_\theta^2/(2Mr^2) + (M\Omega r^2/2)(\Omega/4 - \alpha)$$

where $\Omega = eB/M$.

The last term is proportional to $r^2$, so if $\Omega/4 - \alpha < 0$ then, since the second term decreases as $1/r^2$, $P_r^2$ must increase to keep the left-hand side constant as the particle moves out in radius. This leads to unconfined orbits for masses greater than the cut-off mass given by:

$M_C = e(Ba)^2/(8V_{ctr})$ where we used:

$$\alpha = (V_{ctr} - \Phi)/\Psi = 2V_{ctr}/(a^2B_z) \quad \text{(Eq. 2)}$$

and where a is the radius of the chamber.

So, for example, normalizing to the proton mass, $M_p$, we can rewrite Eq. 2 to give the voltage required to put higher masses on loss orbits:

$$V_{ctr}>1.2\times10^{-1}\ (a(m)B(gauss))^2/(M_C/M_P).$$

Hence, a device radius of 1 m, a cutoff mass ratio of 100, and a magnetic field of 200 gauss require a voltage of 48 volts.

The same result for the cut-off mass can be obtained by looking at the simple force balance equation given by:

$\Sigma F_r=0$ (positive direction radially outward)

$F_c+F_E+F_B=0$ $$Mr\omega^2+eEr-er\omega B_z=0 \qquad \text{(Eq. 3)}$$

which differs from Eq. 1 only by the sign of the electric field and has the solutions:

$$\omega=\Omega/2(1\pm\sqrt{1-4E/(rB_z\Omega)})$$

so if $4E/rB_z\Omega>1$ then $\omega$ has imaginary roots and the force balance cannot be achieved. For a filter device with a cylinder radius "a", a central voltage, $V_{ctr}$, and zero voltage on the wall, the same expression for the cut-off mass is found to be:

$$M_C=ea^2B^2/(8\ V_{ctr}).$$

Where $B=B_z$ in this case, and when the mass M of a charged particle is greater than the threshold value ($M>M_c$), the particle will continue to move radially outwardly until it strikes the wall, whereas the lighter mass particles will be contained and can be collected at the exit of the device. The higher mass particles can also be recovered from the walls using various approaches.

It is important to note that for a given device the value for $M_c$ in equation 3 is determined by the magnitude of the magnetic field, B, and the voltage at the center of the chamber (i.e. along the longitudinal axis), $V_{ctr}$. These two variables are design considerations and can be controlled.

The discussion above has been specifically directed to the case where the magnetic field is oriented substantially parallel to the central longitudinal axis, and has only an axial component $B_z$. For the case wherein the magnetic field has a helical configuration and, thus, has both an axial component, $B_z$, and an azimuthal component, $B_\theta$, a similar analysis leads to slightly different result. The same derivation logic, however, still applies.

To evaluate the effect of the azimuthal component, $B_\theta$, of the magnetic field on the cut-off mass, $M_c$, one can use the Hamiltonian formalism:

$$H=e\Phi+P_r^2/2m+(P_z-eA_z)^2/2m+(P_\theta-e\Psi)^2/2mr^2$$

where $P_r$, $P_z$, $P_\theta$, are respective components of canonical momentum, $\Psi=r^2B_z/2$ and $A_z=B_\theta r\ln(r)$ are components of magnetic vector potential and $\Phi=V_{ctr}-\alpha\Psi$ is the electric potential. Taking into account that the azimuthal and axial components of momentum as well as total particle energy, H, are conserved, one can express the radial component of the momentum, $P_r$, as a function of r:

$$4\ P_r^2/(eBr_o)^2=(M/M_c)\ (x-1)-(1-b^2)\ (x-1)^2/x-b^2\ln^2 x$$

where $x=r^2/r_o^2$, $r_o$ is initial coordinate of the particle, $\Omega=eB/m$ is ion cyclotron frequency, $b=B_\theta(r_o)/B$; $B^2=B_\theta^2+B_z^2$. As in the case of the standard filter the ion orbits can be unconfined (Pr monotonically increases with r) or confined ($P_r=0$ at $r>r_o$) depending on the ratio $M/M_c$ which is defined by a mass of the ions. The additional term in the last equation somewhat increases the cut-off mass which can be described by the following approximate formula:

$$M_c=(ea^2(B_z^2+B_\theta^2)/8V)(1-1.28b^2+1.49b^3-0.56b^4) \qquad \text{(Eq. 4)}$$

which has accuracy better than 1% in the full range of $b_1 0<b<1$. If the ratio $B_\theta/B<1$ then the cut-off mass is not very sensitive to the Bo and hence to the initial radial position of the ion in the filter. For example, if the source of the plasma is limited by the radii, $0.6a<r<a$, and $B_\theta(a)/B_z=0.3$, one can expect variation of the cut-off mass of about 10% which is acceptable for separation of the ions with mass ratio of about 2.

It is also important to note that the addition of the azimuthal magnetic field component, $B_\theta$, creates a controllable axial plasma flow which has an axial velocity, $v_z$, that can be expressed as:

$$v_{z=Er}B_\theta/B^2.$$

At $E_r\sim r$, the axial velocity has a flat radial profile. Further, the magnitude of the axial velocity, $v_z$, is proportional to the axial current, I, that is flowing in the conductor or coil which generates the azimuthal component of the magnetic field, $B_\theta$. It can be mathematically shown that this relationship is:

$$v_z=10^{-7}eI/2M_c.$$

Accordingly, the axial velocity, $v_z$, of plasma flow through a filter can be controlled by variation of the current, I, that creates $B_\theta$.

In light of the above it is an object of the present invention to provide a plasma mass filter with a helical magnetic field which effectively separates low-mass charged particles from high-mass charged particles. It is another object of the present invention to provide a plasma mass filter with a helical magnetic field which has variable design parameters that permit the operator to select a demarcation between low-mass particles and high-mass particles. Still another object of the present invention is to provide a plasma mass filter with a helical magnetic field which allows the operator to control the axial velocity of the plasma through the filter. Yet another object of the present invention is to provide a plasma mass filter with a helical magnetic field which is easy to use, relatively simple to manufacture, and comparatively cost effective.

SUMMARY OF THE INVENTION

A plasma mass filter in accordance with the present invention requires the generation of a helical magnetic field which is crossed with an electric field in a low collisionality environment to separate low-mass particles from high-mass particles in a rotating multi-species plasma. More specifically, the plasma mass filter of the present invention includes a cylindrical shaped outer wall which is distanced from and coaxially oriented with a cylindrical shaped inner wall to establish a plasma chamber between the two walls. For purposes of disclosure, the outer wall is located at a distance "a" from the common longitudinal axis, and the inner wall is located at a distance "b" from the axis.

The helical magnetic field that is generated inside the chamber of the plasma filter includes both an axial component ($B_z$) and an azimuthal component ($B_\theta$). More specifically, the axial component ($B_z$) is generated by a series of magnetic coils that are mounted on the outer wall.

At the same time, the azimuthal component ($B_\theta$) is generated either by a straight conductor that is aligned along the longitudinal axis of the chamber, or by a plurality of coils which are each coplanar with the axis and which have a portion of the coil aligned on the axis. For the present invention, the axial component ($B_z$) and the azimuthal component ($B_\theta$) interact with each other to create the helical magnetic field.

The electric field that is generated inside the chamber of the plasma filter is oriented to be substantially perpendicular to the helical magnetic field. Thus, crossed magnetic and electric fields are established in the plasma chamber. Importantly, the electric field has a positive potential, $V_{ctr}$, on the inner wall near the longitudinal axis, and it has a substantially zero potential on the outer wall. In the operation of the plasma mass filter of the present invention a multi-species plasma, which includes both relatively low-mass to charge particles ($M_1$) and relatively high-mass to charge particles ($M_2$), is injected into the plasma chamber to interact with the crossed magnetic and electric fields. When $M_1<M_c<M_2$ and where $M_c=ea^2(B_z^2+B_\theta^2)/8V_{ctr}$ it will happen that as the multi-species plasma transits the chamber, the high-mass particles ($M_2$) will be ejected from the plasma chamber and into the outer wall. On the other hand, the low-mass particles ($M_1$) will be confined inside the plasma chamber during their transit through the chamber. Due to their respective interactions with the crossed electric and magnetic fields, the low-mass particles are separated from the high-mass particles by the plasma mass filter.

As intended for the present invention, the helical magnetic field functions to establish an axial velocity, $v_z$, for the multi-species plasma as it transits through the plasma chamber. This function, of course, also provides a "lift-off" effect for drawing the multi-species plasma into the chamber in the first instance. Control over the axial velocity, $v_z$, is obtained by varying the current, I, that is passing through the conductor (coils) which creates the azimuthal component, $B_\theta$, of the magnetic field. Specifically, the axial velocity, $v_z$, can be controlled in accordance with the expression; $v_z=10^7eI/2M_c$. Preferably, the current, I, will be in the range of about thirty to forty KAmps d.c. (3040 KAmps).

DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
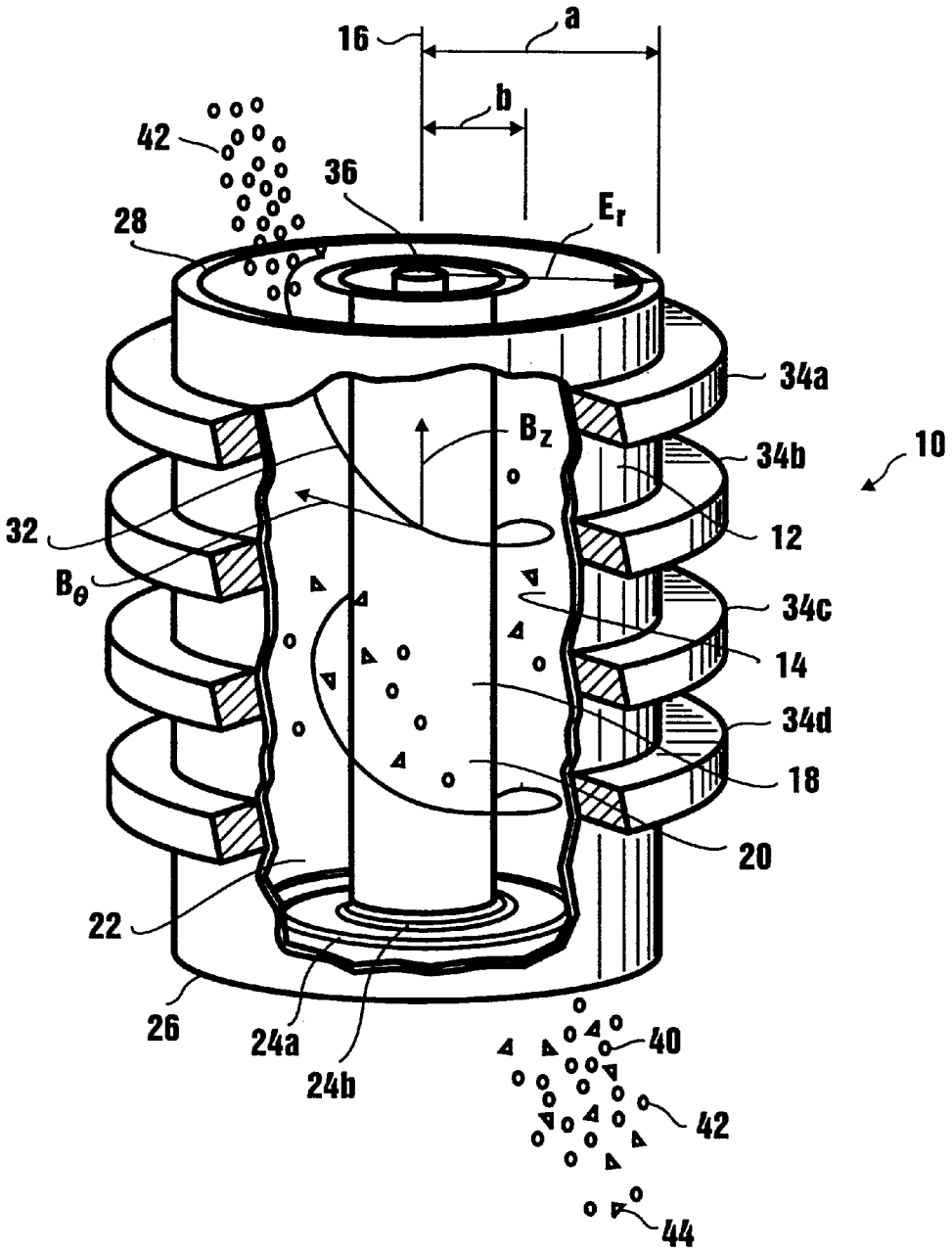
FIG. 1 is a perspective view of the plasma mass filter according to the present invention with portions broken away for clarity.
Figure 2:
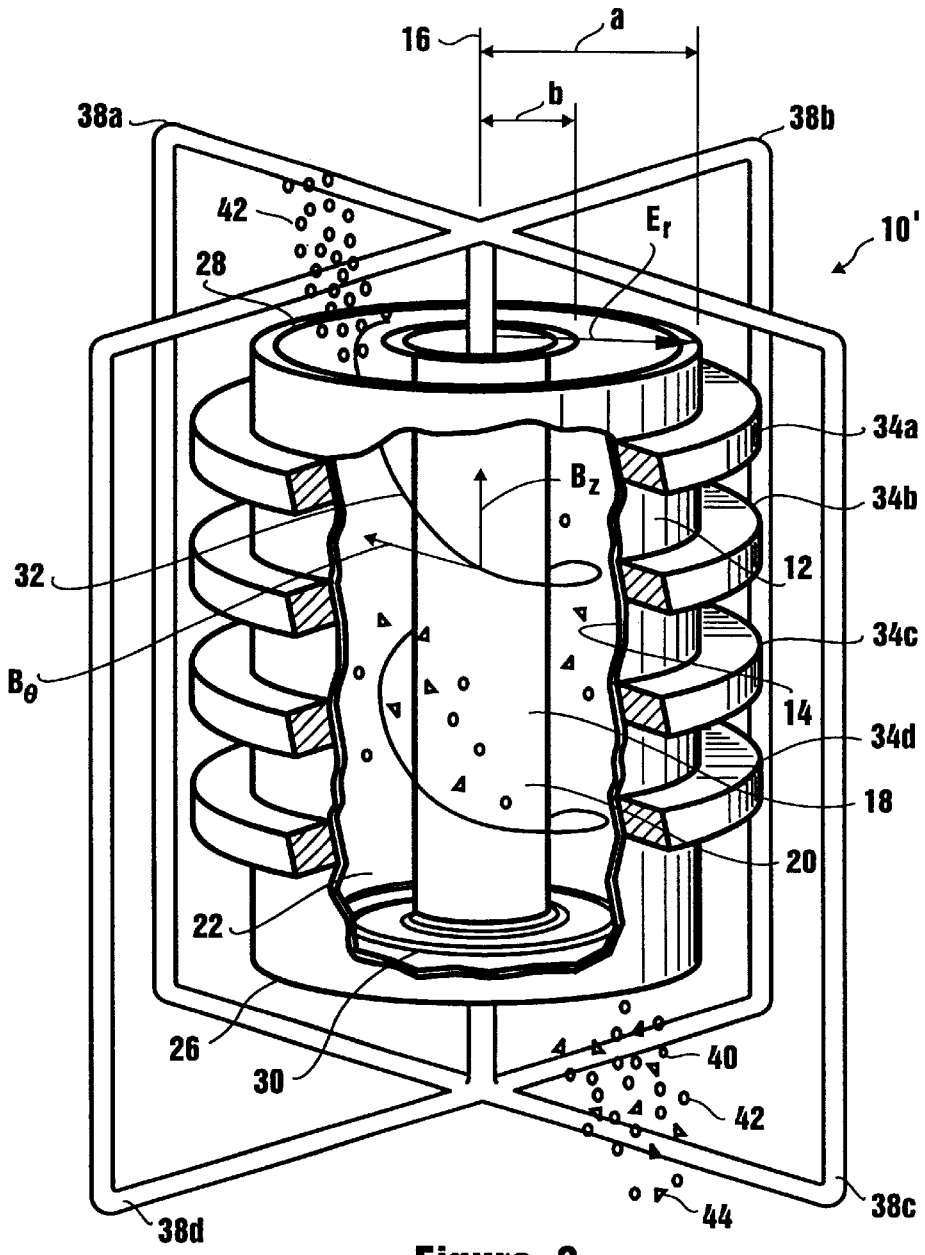
FIG. 2 is a perspective view of an alternate embodiment of the plasma mass filter with portions broken away for clarity.

Referring initially to FIG. 1, one of the preferred embodiments of the plasma mass filter in accordance with the present invention is shown and generally designated 10. Another preferred embodiment of the plasma mass filter is shown in FIG. 2 and is generally designated 10'. In all important respects, the filter 10 and the filter 10' are essentially the same. Accordingly, the components of filter 10 and filter 10' are interchangeable unless suggested otherwise herein.

As shown in FIG. 1, the filter 10 includes an open ended cylinder 12 which establishes an outer wall 14 for the filter 10. Further, the outer wall 14 is oriented on a central longitudinal axis 16, and the outer wall 14 is positioned at a radial distance "a" from the axis 16. Additionally, the filter 10 includes a cylinder 18 which is positioned inside the cylinder 12 and coaxially aligned with the cylinder 12 along the longitudinal axis 16. As shown, the cylinder 18 has an inner wall 20 which is located at a radial distance "b" from the axis 16 to establish a plasma chamber 22 in the region between the outer wall 14 and the inner wall 20.

FIG. 1 also shows that the filter 10 includes a plurality of annular shaped, coaxial electrodes, of which the electrodes 24*a* and 24*b* are representative. For the purposes of the present invention, the electrodes 24*a* and 24*b* are oriented on the longitudinal axis 16 to generate the electric field $E_r$. While it is shown in FIG. 1 that the electrodes 24*a* and 24*b* are located at the entrance end 26 of the plasma chamber 22, it will be appreciated that the electrodes 24*a* and 24*b* could just as easily be placed at the exit end 28 of the plasma chamber 22. Alternatively, electrodes 24*a* and 24*b* can be positioned at both of the ends 26, 28. Further, it will also be appreciated that the electrodes 24*a* and 24*b* can be replaced by a spiral electrode 30 (see FIG. 2). Like the electrodes 24*a* and 24*b*, the spiral electrodes 30 can be positioned at either or both of the ends 26, 28. In any event, the purpose of the electrodes 24*a* and 24*b* (or spiral electrode 30) is to establish a radially oriented electric field, $E_r$, in the plasma chamber 22. Importantly, this electric field, $E_r$, is established with a positive potential, $V_{ctr}$, on the inner wall 20 (i.e. near the longitudinal axis 16) and a substantially zero potential on the outer wall 14. Thus, the orientation of $E_r$ is in a direction that is substantially perpendicular to the longitudinal axis 16. Also, the electric field, $E_r$, is directed radially outward away from the axis 16.

Both FIG. 1 and FIG. 2 show that a helical configured magnetic field is established in the plasma chambers 22 of both the filter 10 and filter 10'. In FIG. 1 and FIG. 2, the spiral path 32 is representative of these magnetic fields and is shown to have an axial component, $B_z$, and an azimuthal component, $B_\theta$. In accordance with the present invention, the axial component, Bz, for both the filter 10 and filter 10' is generated by a plurality of coils, of which the coils 34*a–d* are representative. As shown, the coils 34*a–d* are mounted on the outside of the cylinder 12 and around the axis 16 to generate an axial component, $B_z$, which is substantially parallel to the axis 16.

The azimuthal component, $B_\theta$, of the magnetic field in the plasma chamber 22 can be generated in several ways. One way to generate the azimuthal component, $B_\theta$, is to employ a conductor 36 which is aligned along the longitudinal axis 16 inside the cylinder 18 (see FIG. 1). A power source (not shown) which is connected with the conductor 36 is then activated to run a current, I, through the conductor 36 and thereby generate the azimuthal component, $B_\theta$. Another way to generate the azimuthal component, $B_\theta$, is to employ a plurality of coils, of which the coils 38*a–d* are representative (see FIG. 2). For this particular embodiment of the present invention, it is preferable that each of the coils 38*a–d* extend at least partially along the axis 16. As shown in FIG. 2, the plane of each of the coils 38*a–d* is substantially perpendicular to the respective planes of each of the coils 34*a–d*, and vice versa.

In the operation of the filter 10 or filter 10' of the present invention, a positive voltage, $V_{ctr}$, is established on the inner wall 20 and is controlled by either the annular shaped electrodes 24*a* and 24*b* or the spiral electrode 30, depending on which type of electrodes are used. Also, the coils 34*a–d* are activated to generate the axial component, $B_z$, of the magnetic field, and a current, I, is generated in the conductor 36 (filter 10) or in the coils 38*a–d* (filter 10') to generate the azimuthal component, $B_\theta$, of the magnetic field. Importantly, these variables are established to satisfy the Eq.4 as set forth above.

In accordance with earlier disclosure, when the configuration of filter 10 or filter 10' is established as set forth above, a multi-species plasma 40 can be introduced into the plasma chamber 22 through the entrance end 26. At this point it is to be noted that although both FIG. 1 and FIG. 2 show the entrance end 26 below the exit end 28, the entrance and exit into the plasma chamber 22 can be easily reversed. Indeed, in some instances it may be preferable to reverse the entrance end 26 with the exit end 28 in order to benefit from gravitational effects in the chamber 22, or inject in the center of the device and remove light particles from each end.

For purposes of disclosure, the multi-species plasma 40 will typically include ions (charged particles) of different mass which can be generally categorized as either low-mass to charge particles 42 ($M_1$) or high-mass to charge particles 44 ($M_2$). Although the separation depends on mass to charge state, we will use the convention low mass and high mass with the understanding that multiple charged ions will have lower effective mass. Using these categories, a relationship can be established in the plasma chamber 22 wherein $M_1<M_c<M_2$. Consequently, as the multi-species plasma 40 transits the filter 10 or 10' through the plasma chamber 22, the high-mass particles 44 ($M_2$) will be ejected from the chamber 22 and into the outer wall 14 before completely transiting the filter 10 from entrance end 26 to exit end 28. On the other hand, the low-mass particles 42 ($M_1$) are confined inside the chamber 26 as they transit through the filter 10 (10') and emerge from the exit end 28. Thus, the low-mass particles 42 ($M_1$) are effectively separated from the high-mass particles 44 ($M_2$).

An important aspect of the present invention is that, due to the helical configuration of the magnetic field, charged particles in the multi-species plasma 40 are subjected to forces which will cause the plasma 40 to move through the plasma chamber 22 with an axial velocity, $v_z$. It happens that this axial velocity is controllable and can be established in accordance with the expression: $v_z=10^7eI/2M_c$. In this expression for $v_z$, I is the current in the conductor 36 (filter 10), or the coils 38*a–d* (filter 10'), and $M_c$ is determined as set forth above in Eq. 4. Preferably, I will be in a range of about 30–40 KAmps. The practical effect of this control is that $v_z$ can be established in such a way that the multi-species plasma 40 is more easily drawn into the plasma chamber 22 for further processing. Also, as stated above, $v_z$ assists in moving the multi-species plasma 40 and, specifically, $v_z$ assists in the transit of low-mass particles 42 ($M_1$) through the plasma chamber 22.

While the particular Plasma Mass Filter with Helical Magnetic Field as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A plasma mass filter with helical magnetic field for separating low-mass particles from high-mass particles in a rotating multi-species plasma which comprises:

a substantially cylindrical shaped outer wall defining a longitudinal axis;

a substantially cylindrical shaped inner wall positioned coaxially with said outer wall to establish a plasma chamber therebetween;

a first magnetic means for generating an axial component of a magnetic field ($B_z$);

a second magnetic means for generating an azimuthal component of said magnetic field ($B_\theta$), said axial component ($B_z$) and said azimuthal component ($B_\theta$) interacting with each other to create said helical magnetic field;

means for generating an electric field substantially perpendicular to said helical magnetic field to create crossed magnetic and electric fields in said plasma chamber, said electric field having a positive potential on said inner wall and a substantially zero potential on said outer wall; and means for injecting said rotating multi-species plasma into said plasma chamber to interact with said crossed magnetic and electric field for ejecting said high-mass particles from said plasma chamber into said outer wall and for confining said low-mass particles in said plasma chamber during transit therethrough to separate said low-mass particles from said high-mass particles.

2. A filter with helical magnetic field as recited in claim 1 wherein said outer wall is at a distance "a" from said longitudinal axis, wherein said inner wall is at a distance "b" from said longitudinal axis, wherein said magnetic field has a magnitude "$B_z$" in an axial direction along said longitudinal axis and a magnitude $B_\theta$ in an azimuthal direction around said longitudinal axis, wherein said positive potential on said inner wall has a value "$V_{ctr}$", wherein said outer wall has a substantially zero potential, further wherein b has a value between zero and 1, (0<b<1), and wherein said low-mass particle has a mass less than $M_c$, where $$M_c=(ea^2(B_z^2+B_\theta^2)/8V_{ctr})\{1-1.28b^2+1.49b^3-0.56b^4\}.$$

3. A filter as recited in claim 2 further comprising means for varying said magnitude of said axial component ($B_z$) of said magnetic field relative to said magnitude of said azimuthal component ($B_\theta$) of said magnetic field.

4. A filter as recited in claim 2 further comprising means for varying said positive potential (V) of said electric field at said inner wall.

5. A filter as recited in claim 1 wherein said means for generating said axial component of said magnetic field is a magnetic coil mounted on said outer wall.

6. A filter as recited in claim 1 wherein said means for generating said azimuthal component of said magnetic filed is a straight conductor aligned on said longitudinal axis.

7. A filter as recited in claim 1 wherein said means for generating said azimuthal component of said magnetic field is a plurality of coils with each said coil being coplanar with said longitudinal axis with a portion and each said coil having a portion of said coil aligned substantially along said longitudinal axis.

8. A plasma mass filter for separating low-mass particles from high ss particles in a rotating multi-species plasma which comprises:

a cylindrical shaped wall surrounding a chamber, said chamber defining a longitudinal axis;

means for generating a helical magnetic field in said chamber, said magnetic field having an axial component ($B_z$) and an azimuthal component ($B_\theta$);

means for generating an electric field substantially perpendicular to said magnetic field to create crossed magnetic and electric fields, said electric field having a positive potential on said longitudinal axis and a substantially zero potential on said wall; and means for injecting said multi-species plasma into said chamber to interact with said crossed magnetic and electric fields for moving said multi-species plasma through said chamber in an axial direction with an axial velocity $v_z$, for ejecting said high-mass particles into said wall, and for confining said low-mass particles in said chamber during transit therethrough to separate said low-mass particles from said high-mass particles.

9. A filter as recited in claim 8 wherein said wall is at a distance "a" from said longitudinal axis, wherein said positive potential on said longitudinal axis has a value "$V_{ctr}$", wherein said wall has a substantially zero potential, further wherein b has a value between zero and 1, (0<b<1), and wherein said low-mass particle has a mass less than $M_c$, where $$M_c=(ea^2(B_z^2+B_\theta^2)/8V_{ctr})\{1-1.28b^2+1.49b^3-0.56b^4\}.$$

10. A filter as recited in claim 9 further comprising means for varying said magnitude $(B_z^2+B_\theta^2)$ of said magnetic field.

11. A filter as recited in claim 9 further comprising means for varying a current, I, through said magnetic field generating means to control said velocity, $v_z$, in accordance with the expression; $v_z=10^{-7}eI/2M_c$.

12. A filter as recited in claim 9 wherein said multi-species plasma is injected into said chamber at a distance r from said longitudinal axis with 0.6a<r<a, and wherein said azimuthal component of said magnetic field at the outer wall, $B_{\theta a}$, is such that $B_{\theta a}/B_z<0.5$.

13. A filter as recited in claim 9 wherein said means for generating said axial component of said magnetic field is a magnetic coil mounted on said wall.

14. A filter as recited in claim 9 wherein said means for generating said electric field is a series of conducting rings mounted on said longitudinal axis at one end of said chamber.

15. A filter as recited in claim 9 wherein said means for generating said electric field is a spiral electrode.

16. A method for separating low-mass particles from high-mass particles in a multi-species plasma which comprises the steps of:

surrounding a chamber with a cylindrical shaped wall, said chamber defining a longitudinal axis;

generating a helical magnetic field in said chamber, said magnetic field having an axial component ($B_z$) and an azimuthal component ($B_\theta$), and generating an electric field substantially perpendicular to said magnetic field to create crossed magnetic and electric fields, said electric field having a positive potential near said longitudinal axis and a substantially zero potential on said wall; and injecting said multi-species plasma into said chamber to interact with said crossed magnetic and electric fields for moving said multi-species plasma through said chamber in an axial direction with an axial velocity $v_z$, for ejecting said high-mass particles into said wall and for confining said low-mass particles in said chamber during transit therethrough to separate said low-mass particles from said high-mass particles.

17. A method as recited in claim 16 wherein said wall is at a distance "a" from said longitudinal axis, wherein said positive potential on said longitudinal axis has a value "$V_{ctr}$", wherein said wall has a substantially zero potential, further wherein b has a value between zero and 1, (0<b<1), and wherein said low-mass particle has a mass less than Mc, where $$M_c=(ea^2(B_z^2+B_\theta^2)/8V_{ctr})\{1-1.28b^2+1.49b^3-0.56b^4\}.$$

18. A method as recited in claim 16 further comprising the step of varying said magnitude $(B_z^2+B_\theta^2)$ of said magnetic field to alter $M_c$.

19. A method as recited in claim 16 further comprising the step of varying said positive potential ($V_{ctr}$) of said electric field at said longitudinal axis to alter $M_c$.

20. A method as recited in claim 16 further comprising the step of varying a current, I, to generate magnetic field with control over said velocity, $v_z$, in accordance with the expression; $v_z=10^{-7}eI/2M_c$.

* * * * *

UNITED STATES PATENT AND TRADEMARK OFFICE

CERTIFICATE OF CORRECTION

PATENT NO. : 6,251,282 B1
DATED : June 26, 2001
INVENTOR(S) : Surgei Putvinski; Tihiro Ohkawa; Richard L. Freeman It is certified that error appears in the above-identified patent and that said Letters Patent is hereby corrected as shown below:

Column 1,
Line 7, delete "6,093,320" insert -- 6,096,220 --

Column 2,
Line 7, delete "native" insert -- negative --
Line 12, delete "ω" insert -- Ω --
Line 40, delete "(2Mr2)" insert -- ($2Mr^2$) --
Line 44, delete "$\Psi = V_{ctr} - \alpha\Psi$ is the electric potential. $E = -\nabla\Psi$" insert -- $\Phi = V_{ctr} - \alpha\Psi$ is the electric potential. $E = -\nabla\Phi$ --

Column 3,
Line 20, delete "ω." insert -- ω --

Column 4,
Line 1, delete "Pr" insert -- $P_r$ --
Line 9, delete "$b_1 0$" insert -- b, 0 --
Line 10, delete "Bo" insert -- $B_\theta$ --
Line 22, delete "$v_z = E_r B_\theta / B^2$" insert -- $v_z = E_r B_\theta / B^2$ --

Column 5,
Line 41, delete "3040" insert -- 30-40 --

Column 6,
Line 42, delete "Bz" insert -- $B_z$ --

UNITED STATES PATENT AND TRADEMARK OFFICE

CERTIFICATE OF CORRECTION

PATENT NO. : 6,251,282 B1 
DATED : June 26, 2001
INVENTOR(S) : Surgei Putvinski; Tihiro Ohkawa; Richard L. Freeman It is certified that error appears in the above-identified patent and that said Letters Patent is hereby corrected as shown below:

Column 8,
Line 58, delete "high ss" insert -- high-mass --

Column 9,
Line 31, delete "<" insert -- $\leq$ --

Column 10,
Line 26, delete "Mc" insert -- $M_c$ --

Signed and Sealed this

Nineteenth Day of February, 2002

*Attest:*

*Attesting Officer*

JAMES E. ROGAN
*Director of the United States Patent and Trademark Office*